US012404566B2

(12) United States Patent
Takehara et al.

(10) Patent No.: US 12,404,566 B2
(45) Date of Patent: Sep. 2, 2025

(54) METHOD FOR PRODUCING SINTERED ORE

(71) Applicant: JFE STEEL CORPORATION, Tokyo (JP)

(72) Inventors: Kenta Takehara, Tokyo (JP); Tetsuya Yamamoto, Tokyo (JP); Takahide Higuchi, Tokyo (JP)

(73) Assignee: JFE STEEL CORPORATION, Tokyo (JP)

( * ) Notice: Subject to any disclaimer, the term of this patent is extended or adjusted under 35 U.S.C. 154(b) by 517 days.

(21) Appl. No.: 17/801,141

(22) PCT Filed: Feb. 22, 2021

(86) PCT No.: PCT/JP2021/006552
§ 371 (c)(1),
(2) Date: Aug. 19, 2022

(87) PCT Pub. No.: WO2021/172254
PCT Pub. Date: Sep. 2, 2021

(65) Prior Publication Data

US 2023/0085232 A1 Mar. 16, 2023

(30) Foreign Application Priority Data

Feb. 27, 2020 (JP) ..... 2020-031953

(51) Int. Cl.
*C22B 1/18* (2006.01)
*C21B 13/00* (2006.01)

(52) U.S. Cl.
CPC ..... *C22B 1/18* (2013.01); *C21B 13/0086* (2013.01)

(58) Field of Classification Search
CPC ..... C21B 13/0086; C21B 13/004; C21B 13/0046; F27B 21/00; C22B 1/205
See application file for complete search history.

(56) References Cited

FOREIGN PATENT DOCUMENTS

| | | | |
|---|---|---|---|
| CN | 1198779 | A | 11/1998 |
| EP | 0 861 908 | A1 | 9/1998 |
| EP | 0861908 | B1 | 10/2002 |

(Continued)

OTHER PUBLICATIONS

Jan. 4, 2024 Office Action issued in Chinese Patent Application No. 202180014681.5.

(Continued)

*Primary Examiner* — Christina A Johnson
(74) *Attorney, Agent, or Firm* — Oliff PLC

(57) ABSTRACT

A method produces a high-strength sintered ore while maintaining a high production rate by performing appropriate oxygen enrichment at a position closer to an ore discharging section than an ignition position without using gaseous fuel in the operation of a sintering machine. In a method for producing sintered ore including sequentially combusting carbonaceous material in a sinter bed (raw material charged layer) in a DL sintering machine to sinter the mixed raw material, in performing oxygen enrichment from above the raw material charging layer on the sintering machine, the oxygen enrichment is performed at a position closer to the ore discharging section than the position where 4 minutes have passed since the upper surface of the charging layer was ignited

4 Claims, 1 Drawing Sheet

(56) References Cited

FOREIGN PATENT DOCUMENTS

| | | | | |
|---|---|---|---|---|
| JP | H02-073924 | A | | 3/1990 |
| JP | H09-227958 | A | | 9/1997 |
| JP | 2008-095170 | A | | 4/2008 |
| JP | 2010-126773 | A | | 6/2010 |
| JP | 2014-031580 | A | | 2/2014 |
| JP | 2015-157980 | A | | 9/2015 |
| JP | 2015157979 | A | * | 9/2015 |
| JP | 2016-056404 | A | | 4/2016 |
| JP | 2019-059976 | A | | 4/2019 |
| WO | 98/07891 | A1 | | 2/1998 |
| WO | 2011/118822 | A1 | | 9/2011 |
| WO | 2017/033395 | A1 | | 3/2017 |

OTHER PUBLICATIONS

Apr. 6, 2021 International Search Report issued in International Patent Application No. PCT/JP2021/006552.
Dec. 8, 2022 Extended European Search Report Issued in European Patent Application No. 21761195.3.
Mar. 8, 2023 Office Action issued in Japanese Patent Application No. 2022-503593.
May 27, 2024 Office Action issued in Korean Patent Application No. 10-2022-7027742.

* cited by examiner

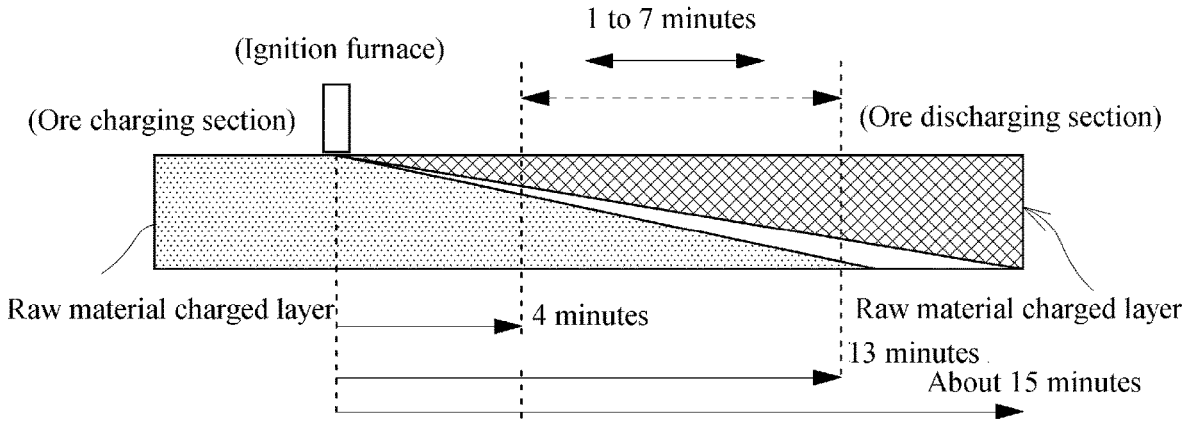
1 to 7 minutes
(Ignition furnace)
(Ore charging section)
(Ore discharging section)
Raw material charged layer
4 minutes
Raw material charged layer
13 minutes
About 15 minutes

METHOD FOR PRODUCING SINTERED ORE

TECHNICAL FIELD

The present invention relates to a method for producing sintered ore by operating oxygen enrichment in a downdraft-type Dwight-Lloyd (DL) sintering machine.

BACKGROUND ART

A blast furnace is a facility for producing molten iron by charging an iron source such as lump ore or sintered ore from the upper part of the furnace while blowing reducing gas from the lower part of the furnace to thus reduce and melt the iron source. In general, the inside of the blast furnace needs to secure sufficient flow of the reducing gas to promote the reaction of the reducing gas and the iron source. To this end, it is effective to increase the air permeability in the blast furnace, resulting in a higher production rate and lower costs of molten iron. In order to increase the air permeability in the blast furnace, it is necessary to suppress the powder ratio of the iron source material, for which the use of a material with high strength is effective. Thus, there have been proposed various methods for increasing the strength of sintered ore as iron source material to be charged into the blast furnace.

For example, Patent Literature 1 proposes a method for improving the yield by blowing oxygen toward the raw material charged layer on the pallet of a DL sintering machine to thus promote combustion. The method disclosed in the Patent Literature 1 involves oxygen enrichment to the upper layer part of the material charged layer on the pallet for the purpose of improving productivity, increasing yield, or reducing the powder generation rate during the breakage of sinter cake. In this known method, however, the position for oxygen enrichment is limited to the ignition position to the raw material charged layer, and the subsequent oxygen enrichment has no effect. The method has no description regarding the specific properties of the raw material, and dose not refer to the strength of product sintered ore, especially a method for reducing the powder generated during transport and storage until it reaches the inside of the blast furnace.

Patent Literature 2 proposes a method of producing sintered ore by feeding gaseous fuel to the raw material charged layer on the pallet of a DL sintering machine. This method allows more expanded combustion area (combustion zone) in the raw material charged layer during sintering and heat compensation in areas with low strength during production, thereby improving the strength of a product.

Patent Literature 3 proposes a method of producing high-strength sintered ore by simultaneously blowing gaseous fuel along with oxygen during sintering to thus create temperature conditions suitable for sintering in the raw material charged layer.

CITATION LIST

Patent Literature

Patent Literature 1: JP-H02-073924A
Patent Literature 2: JP-2008-95170A
Patent Literature 3: JP-2014-31580A
Patent Literature 4: JP-2010-126773A
Patent Literature 5: JP-H09-229758A

SUMMARY OF INVENTION

Technical Problem

The above conventional methods, especially the method described in Patent Literature 1, performs oxygen enrichment to the upper layer part of the raw material charged layer only immediately after ignition to compensate for the combustion melting reaction (sintering reaction) in the upper layer part of the raw material charged layer having a little heat input. Although this method reduces the powder generation ratio during sinter cake breakage, it has no significant effect on reducing the strength of the whole finished product sintered ore after breakage, i.e., reducing the powder generated during transportation to and storage in the blast furnace.

The methods disclosed in Patent Literatures 2, 3, and 4 all involve using gaseous fuel together, causing problems in costs. In the methods, the area where combustion and liquid melting are caused is expanded, resulting in poor air permeability and low productivity.

Patent Literature 5 proposes a method of performing oxygen enrichment to the middle layer part of the raw material charged layer, as part of an exhaust gas recirculation process in a sintering machine. That is, the method proposes sucking the oxygen-enriched air and circulating exhaust gas into the middle layer part of the raw material charged layer, further sucking the exhaust gas resulting from the reaction of the above gases into the lower layer part of the raw material charged layer. In this method, however, since the oxygen concentration of the circulating exhaust gas is low to cause stagnation of the combustion reaction in the lower layer part, low-concentration oxygen enrichment is performed on the middle layer part in advance. Thus, this method is not designed to promote the sintering reaction in the middle layer part. Moreover, in this method, the exhaust gas recirculation process is intended to reduce the environmental load caused by the exhaust gas from the sintering machine, and the ratio of the area where oxygen-enriched air and circulating exhaust gas are sucked in should be designed according to the raw materials, sintering machine, and exhaust gas treatment facility conditions. Thus, it is not expected to have a sintering reaction effect purely due to the oxygen enrichment. Therefore, in the first place, oxygen enrichment to the sintering raw material layer should not be used in combination with the exhaust gas recirculation process.

The object of the present invention is to propose a method for producing a high-strength sintered ore at a high production rate without using gaseous fuel in the operation of a sintering machine and by performing proper oxygen enrichment at a position closer to an ore discharging section than the ignition position.

Solution to Problem

In order to solve the problems and achieve the object described above, the inventors suspended the supply of the gaseous fuel from above the sinter bed (raw material charged layer) in the sintering machine while continuing the oxygen enrichment to thus study the influence of the positions (timing) and time of the oxygen enrichment upon the strength and productivity of sintered ore. As a result, they found that the method disclosed in Patent Literature 1, that is, the oxygen enrichment performed at the timing of combustion of the upper layer part of the sinter bed (raw material charged layer) increases yield but hardly increases the strength of a finished product (sintered ore). This seems because, under the conventional method described above, the strength of the upper layer part of the raw material charged layer is low due to insufficient sintering reaction, and it increases, by oxygen enrichment, to the extent that powdering is not caused but not as high as that of the middle and lower parts of the material charged layer, failing to improve the overall strength of the finished product.

Therefore, the inventors performed oxygen enrichment using oxygen-enriched air at the timing of combustion not only in the upper layer part of the raw material charged layer but also in the middle and lower layer parts thereof. As a result, they found that the oxygen enrichment in the middle and lower layer parts of the raw material charged layer can dramatically increase the overall strength of a finished product, with a low pulverization rate during crushing and a certain degree of strength expected and without reducing the production rate while decreasing the yield.

In particular, the inventors found that oxygen enrichment for at least the middle layer part of the raw material charged layer has a greater effect on increasing the overall strength of a finish product, and that, on the premise of oxygen enrichment for the middle layer part, it is effective to perform, if necessary, further oxygen enrichment for at least one of the upper layer part and lower layer part of the raw material charged layer.

That is, the present invention is a method for producing sintered ore including charging mixed raw material for sintering containing iron ore and carbonaceous material into a raw material ore charging section on a pallet that circulates in a sintering machine to thus form a raw material charged layer, igniting the carbonaceous material on the upper surface (upper layer part) of the raw material charged layer by an ignition furnace disposed downstream of the raw material ore charging section while sucking gas above the raw material charged layer through a wind box disposed below the pallet, introducing the gas into the raw material charged layer to sequentially ignite the carbonaceous material in the raw material charged layer and thus sinter the mixed material, in which, in performing oxygen enrichment from above the raw material charging layer on the sintering machine, the oxygen enrichment is started at a position closer to an ore discharging section than the position where 4 minutes have passed since the upper surface of the charging layer was ignited.

(1) In the method according to the present invention, it is preferable that the oxygen enrichment is completed within 13 minutes after the raw material charging layer is ignited.

(2) In the method according to the present invention, it is preferable that the time of the oxygen enrichment to the raw material charged layer is from 1 to 7 minutes as the passage time of the mixed raw material for sintering.

(3) In the method according to the present invention, it is preferable that the oxygen enrichment is not performed until 4 minutes have elapsed after the upper surface of the charging layer is ignited.

(4) In the method according to the present invention, it is preferable that the method is not used in combination with an exhaust gas recirculation process.

(5) In the method according to the present invention, it is preferable that the oxygen concentration of the oxygen-enriched air to be introduced onto the raw material charged layer is more than 25 vol. %.

Advantageous Effects of Invention

The method according to the present invention having the above configuration can, firstly, increase the effect of oxygen enrichment and improve the strength of sintered ore. The oxygen enrichment based on the conventional methods assists the combustion of coke to the upper part of the sinter bed (sintering raw material layer) at an early stage (immediately after ignition) or supplements circulating exhaust gas, and is effective in improving yield, but not so much in improving strength. Whereas, the method of the present invention is to apply oxygen enrichment to the middle and lower layer parts of the sinter bed (raw material charging layer), allowing a dramatic increase in the strength of a whole finished product (sintered ore) without causing a decrease in yield (production rate). In particular, as being a proper oxygen enrichment treatment to the middle layer part of the raw material charged layer, the method of the present invention can mitigate excessive heat supply, avoiding such a phenomenon that the strength is conversely reduced. In other words, the method of the present invention allows effective oxygen enrichment of the middle layer part of the raw material charged layer, which is highly effective in improving the strength.

Although being less effective in improving strength as compared with oxygen enrichment of the middle layer part, the oxygen enrichment to the upper layer part and/or lower layer part of the raw material charged layer does not interfere with the effect of oxygen enrichment of the middle layer part, so that it may be conducted in conjunction with oxygen enrichment to the middle layer part.

BRIEF DESCRIPTION OF DRAWINGS

FIG. 1 is a schematic diagram showing the state of the cross-section of a raw material charged layer between an ore charging section and an ore discharge section thereof on the DL sintering machine pallet.

DESCRIPTION OF EMBODIMENTS

The present invention proposes a method for producing sintered ore by operating oxygen enrichment with a downward suction Dwight-Lloyd (DL) sintering machine, in which, basically, the effect of the oxygen enrichment appears at least when the middle layer part of a raw material charged layer is combusted. In the present invention, therefore, the upper surface of the raw material charged layer is first ignited, and after a certain period of time has elapsed, the blowing of oxygen-enriched gas, i.e., the oxygen enrichment to the middle layer part is started. In other words, the oxygen enrichment is started after the raw material charged layer on the pallet moves toward the ore discharging section for a certain period of time after ignition and completed after being conducted for a predetermined period of time.

As described above, the present invention is a method including oxygen enrichment by blowing oxygen-enriched gas from above the raw material charged layer on the pallet of the sintering machine after a lapse of a prescribed time after ignition. That is, the present invention is characterized by performing oxygen enrichment by feeding oxygen-enriched gas to a position closer to the ore discharging section than the position where 4 minutes have passed at the normal sintering machine pallet speed (1.5 to 3.5 m/min) since the upper surface of the charging layer was ignited, and continuing the feeding for a certain time toward the ore discharging side.

The time when the upper surface of the material charging layer is ignited can be determined by measuring with a thermometer or the like, but for simplicity, the time when the upper surface passes through the outlet of the ignition furnace can be considered as the ignition time.

When performing the oxygen enrichment to the middle layer part of the raw material charged layer by introducing oxygen-enriched gas at the above-described position, in both cases of using oxygen-enriched air that is obtained by enriching the air directly sucked from the outside air with oxygen of a specified concentration and of circulating the exhaust gas from the sintering machine, it is preferable to use a hood-shaped cover and feed oxygen into the cover for the purpose of preventing abnormal combustion in an unintended position due to leakage of oxygen for the enrichment and achieving reliable oxygen enrichment in a designated position.

In the present invention, in order to secure the prescribed sintering time and to proceed with the sintering reaction sufficiently, the oxygen concentration of the oxygen-enriched air to be introduced should be not less than 21 vol. % but not more than 50 vol. %. This is because, when the oxygen concentration after oxygen enrichment exceeds 50 vol. %, the coke combustion becomes faster to thus increase the moving speed of the combustion zone, so that the time for holding a high temperature at which the combustion zone remains in each layer is reduced, failing in sufficient sintering reaction. That is also because when the oxygen concentration after oxygen enrichment is less than 21 vol. %, the oxygen concentration is lower than that of normal air and lower rather than when the air outside is directly sucked, decreasing the sinterability. Preferably, the oxygen concentration is not less than 23 vol. % but not more than 50, more preferably not less than 25 vol. % but not more than 50 vol. %.

There is conducted a test on a preferable method of oxygen enrichment to the middle layer part conforming to the present invention, the result of which is described in the following.

(Test 1)

In this test, oxygen enrichment is performed in such a manner that a sinter bed (raw material charged layer) was divided into three equal parts (upper, middle, and lower layers) in the direction of height and oxygen-enriched air was introduced into each location. First, a sintering test (Comparative Example 1) without oxygen enrichment was conducted as the base case to determine the base (standard) sintering time (15.5 minutes). The oxygen enrichment time was determined by subtracting the time required for the ignition operation (1 minute) from the sintering time and dividing it into three equal parts was determined (formula below).

$$\text{Oxygen enrichment time}=(\text{base sintering time}-1)/3$$

In this test, mixed raw material for sintering as shown in Table 1 was used as the sintering raw material, which was adjusted to have a basicity (B2) of 2.0. The mixed raw material for sintering was granulated in a drum mixer while adding moisture to bring the moisture content to 7.5 mass %, and the resulting granulated material was sintered using a sintering pot. In this sintering test, the air pressure was kept constant (6 kPa) and the oxygen concentration of the oxygen-enriched air was kept at 30 vol. %.

TABLE 1

| | (mass %) |
|---|---|
| Australian ore A | 33.9 |
| Brazilian ore A | 23.8 |
| Brazilian ore B | 10.2 |
| Return ore | 20.0 |
| Silica sand | 0.1 |
| Limestone | 11.0 |
| Quicklime | 1.0 |
| Total | 100 |
| Coke breeze | 4.5 |

Table 2 shows the result. In this test, the base sintering time is 15.5 minutes, which means that the oxygen enrichment time for each position is 4.8 minutes. Thus, the oxygen enrichment of 4.8 minutes was performed in the upper layer (Comparative Example 2), middle layer (Inventive Example 1), and lower layer (Inventive Example 2) of the sintering raw material layer. The result shows that the strength of the sintered ore (TI strength) could be improved the most when the oxygen enrichment was applied to the middle layer. This means that it is the most preferable to perform oxygen enrichment for 5.8 minutes after the ignition was started, that is, for the next 4.8 minutes after 4.8 minutes have elapsed since the ignition was completed. In consideration of the oxygen enrichment effect on the upper layer part (Comparison Example 2) and the lower layer part (Invention Example 2), it is effective to perform oxygen enrichment to the sinter bed (sintering raw material layer) at a position closer to the ore discharging section than the position where 4 minutes has passed after the ignition.

The result shown in Table 2 indicates that the oxygen enrichment to the lower layer part following the middle layer part also improves the strength, although not as much as to the middle layers. This means that oxygen enrichment when conducted during the 4.8-minute period after 10.6 minutes from the start of ignition (after 9.6 minutes from the completion of ignition), does not reduce the effect of oxygen enrichment. In other words, the effect of increasing the strength by the oxygen enrichment to the lower layer part of the sintering raw material layer (63.5%−61.6%=1.9) was equivalent to 53% of the effect of increasing the strength by the oxygen enrichment to the middle layer part (65.2%−6.1.6%=3.6).

This is considered to result from excessive heat in the lower layer part, especially in the bottom part thereof, where the increase in strength due to the progress of sintering and the decrease in strength due to overheating cancel each other out. Therefore, when oxygen enrichment is performed on the lower layer part, it should be limited to within 2.5 minutes (4.8 minutes×53%) from 10.6 minutes after the start of ignition (9.6 minutes after completion of ignition), i.e., the oxygen enrichment should be performed within 13 minutes (10.6 minutes+2.5 minutes) after the ignition is started on the upper surface of the raw material charged layer.

TABLE 2

| | Comparative Example 1 | Comparative Example 2 | Inventive Example 1 | Inventive Example 2 |
|---|---|---|---|---|
| Position of oxygen enrichment | — | Upper layer part | Middle layer part | Lower layer part |
| Yield (%) | 70.4 | 72.0 | 68.8 | 66.7 |
| Sintering time (min) | 15.5 | 15.2 | 14.7 | 14.6 |

TABLE 2-continued

| | Comparative Example 1 | Comparative Example 2 | Inventive Example 1 | Inventive Example 2 |
|---|---|---|---|---|
| Production rate ($t/h/m^2$) | 1.43 | 1.49 | 1.48 | 1.44 |
| TI strength (%) | 61.6 | 62.0 | 65.2 | 63.5 |

EXAMPLE

The examples described below examined the influence of the oxygen enrichment time in the middle layer part of the sintered raw material layer. A mixed raw material for sintering adjusted to have $SiO_2$: 4.9 mass % and a basicity: 2.0 (Table 1) was used. The mixed raw material for sintering was granulated in a drum mixer while adding water to bring the moisture content to 7.5 mass %, and the resulting granulated raw material for sintering was subjected to a sintering test in a sintering pot, where the air pressure is constant (6 kPa) and the oxygen concentration of the granulated raw material for sintering was adjusted to 30 vol. %. The sintering time of the base case without oxygen enrichment (Comparative Example 1) was 15.5 minutes. In this test, the timing of the oxygen enrichment was within the period of 5.8 to 10.6 minutes after the ignition (in the middle layer part), and the duration of the oxygen enrichment was changed to 0.3 to 4.8 min.

As shown in Table 3, the result shows that oxygen enrichment time to the middle layer of not shorter than 1.0 minutes caused, at least, a significant improvement in the production rate and sintered ore strength (TI strength). Although the oxygen enrichment time is not specified, as described above, 7 minutes, which corresponds to the total of 4.8 minutes for oxygen enrichment to the middle layer part and 2.5 minutes to be 53% of 4.8 minutes to the lower layer part, is thought to be effective.

TABLE 3

| | Comparative Example 1 | Example 1 | Example 2 | Example 3 |
|---|---|---|---|---|
| Oxygen enrichment time (min) | 0 | 0.3 | 1 | 4.8 |
| Yield (%) | 70.4 | 69.7 | 69.7 | 68.8 |
| Sintering time (min) | 15.5 | 15.3 | 15.1 | 14.7 |
| Production rate ($t/h/m^2$) | 1.43 | 1.46 | 1.46 | 1.48 |
| TI strength (%) | 61.6 | 62.0 | 63.7 | 65.2 |

The example described below verified the influence of oxygen concentration during oxygen enrichment treatment on the middle layer part of the sintered raw material layer. A mixed raw material for sintering adjusted to have $SiO_2$: 4.9 mass % and a basicity: 2.0 (Table 1) was used. The mixed raw material for sintering was granulated in a drum mixer while adding water to bring the moisture content to 7.5 mass %. The resulting granulated raw material for sintering was subjected to a sintering test in a sintering pot by using oxygen-enriched air adjusted to have a constant air pressure (6 kPa) and the oxygen concentration of the granulated raw material for sintering of 30 vol. %. As in Example 3, oxygen enrichment was conducted for 5.8 minutes after the ignition was started, that is, for the next 4.8 minutes after 4.8 minutes have elapsed since the ignition was completed. The oxygen concentration during the oxygen enrichment was changed within the range of 30 to 40 vol. %. As shown in FIG. 4, the result shows that the strength continues increasing until the concentration of the oxygen-enriched air reaches 40 vol. %.

TABLE 4

| | Example 3 | Example 6 | Example 7 |
|---|---|---|---|
| Oxygen enrichment time (min) | 4.8 | 4.8 | 4.8 |
| Yield (%) | 68.8 | 71.7 | 72.1 |
| Sintering time (min) | 14.7 | 14.6 | 13.9 |
| Production rate ($t/h/m^2$) | 1.48 | 1.56 | 1.64 |
| Oxygen concentration of oxygen-enriched air (vol. %) | 30 | 35 | 40 |
| TI strength (%) | 65.2 | 66.9 | 67.4 |

INDUSTRIAL APPLICABILITY

The invention has been described based primarily on the operation of sintering machines that do not use gaseous fuels, but the invention can also be applied to the operation of sintering machines that use gaseous fuels in combination.

The invention claimed is:

1. A method for producing sintered ore comprising charging mixed raw material for sintering containing iron ore and carbonaceous material into a raw material ore charging section on a pallet that circulates in a sintering machine to thus form a raw material charged layer, igniting the carbonaceous material on an upper surface (upper layer part) of the raw material charged layer by an ignition furnace disposed downstream of the raw material ore charging section while sucking gas above the raw material charged layer through a wind box disposed below the pallet, and introducing the gas into the raw material charged layer to sequentially ignite the carbonaceous material in the raw material charged layer and thus sinter the mixed material, wherein in performing oxygen enrichment from above the raw material charged layer on the sintering machine, the oxygen enrichment is performed for a duration of 1 to 7 minutes during a period of time starting 5.8 minutes after the upper surface of the charged layer is ignited, and the oxygen enrichment is completed within 13 minutes after the raw material charged layer is ignited.

2. The method for producing sintered ore according to claim 1, wherein oxygen enrichment is not performed before 4 minutes have elapsed after the upper surface of the charged layer is ignited.

3. The method for producing sintered ore according to claim 1, wherein the method is not used in combination with an exhaust gas recirculation process.

4. The method for producing sintered ore according to claim 1, wherein the oxygen concentration of the oxygen-enriched air to be introduced onto the raw material charged layer is more than 25 vol. %.

* * * * *